US006543252B1

(12) United States Patent
Fuentes et al.

(10) Patent No.: US 6,543,252 B1
(45) Date of Patent: Apr. 8, 2003

(54) VAPORIZER-CONDENSER AND CORRESPONDING AIR DISTILLATION INSTALLATION

(75) Inventors: Francois Fuentes, Le Vesinet (FR); Marc Wagner, Saint Maur des Fosses (FR); Claude Gerard, Chantraine (FR)

(73) Assignee: L'Air Liquide - Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 253 days.

(21) Appl. No.: 09/635,409

(22) Filed: Aug. 10, 2000

(30) Foreign Application Priority Data

Aug. 24, 1999 (FR) ..... 99 10738

(51) Int. Cl.[7] ..... F25J 1/00

(52) U.S. Cl. ..... 62/643; 62/903; 62/905; 165/166; 202/158

(58) Field of Search ..... 62/643, 903, 905; 165/164, 165, 166, 167; 202/158

(56) References Cited

U.S. PATENT DOCUMENTS 3,256,704 A * 6/1966 Becker ..... 62/903
3,282,334 A * 11/1966 Stahlheber ..... 62/903
3,421,335 A * 1/1969 Becker ..... 62/903
4,330,308 A 5/1982 Grenier et al.
5,509,471 A 4/1996 Hallgren
5,755,280 A 5/1998 de Costa et al.
5,787,975 A * 8/1998 Grenier et al. ..... 62/903

FOREIGN PATENT DOCUMENTS

DE 1152432 4/1962

* cited by examiner

*Primary Examiner*—Ronald Capossela
(74) *Attorney, Agent, or Firm*—Young & Thompson

(57) ABSTRACT

The invention relates to a vaporizer-condensor (4) of the bath type, comprising at least one heat exchange body (13), having a multitude of flat passages (18) for the countercurrent circulation of two fluids in a same direction, and a sealed chamber (14) for confining a fluid containing the or each heat exchange body, the confinement chamber comprising a central section (50) of generally cylindrical shape along a longitudinal axis (Y—Y).

The longitudinal axis of the central section of said or each confinement chamber is orthogonal to the direction of countercurrent circulation of the fluids in the flat passages of the corresponding heat exchange body.

Use in double column air distillation installations.

29 Claims, 4 Drawing Sheets

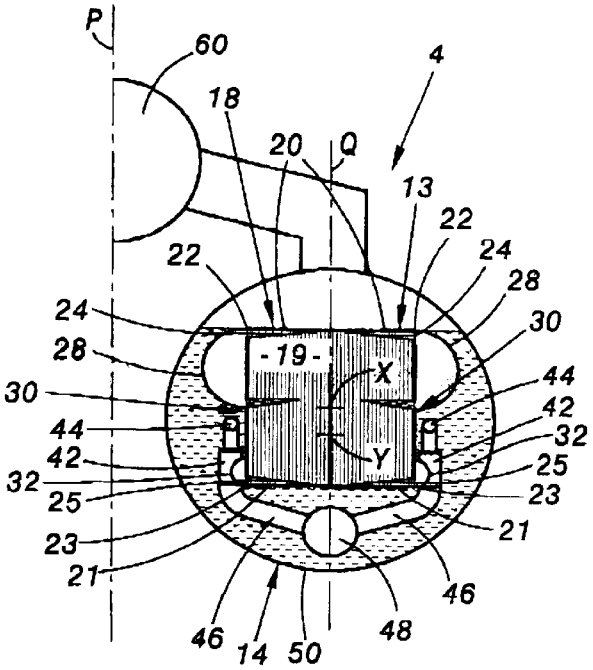
FIG.4
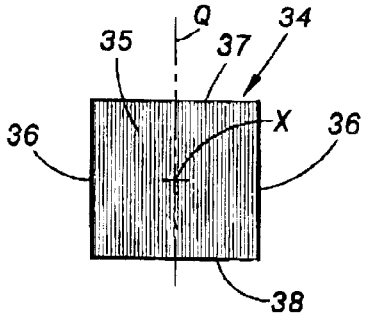
FIG.5
FIG.6
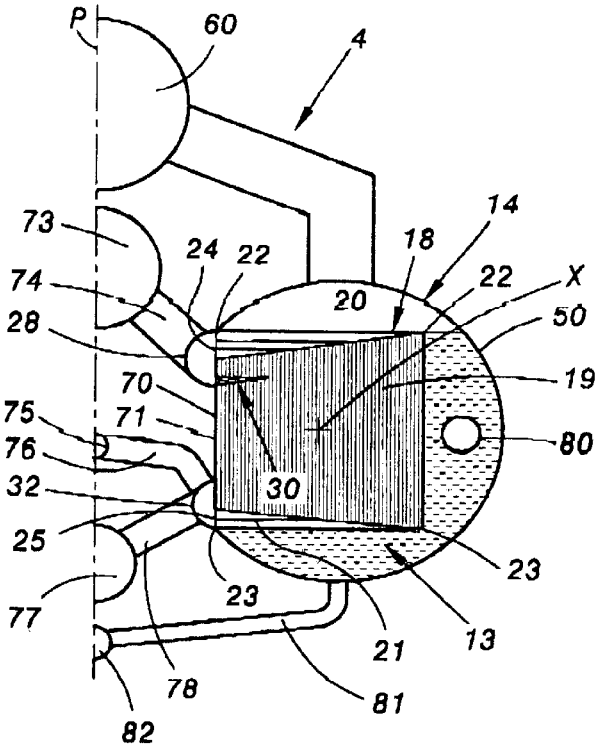

VAPORIZER-CONDENSER AND CORRESPONDING AIR DISTILLATION INSTALLATION

FIELD OF THE INVENTION

The present installation relates to a vaporizer/condenser of the bath type, comprising at least one heat exchange body, having a multitude of flat passages for the countercurrent circulation of two fluids, from one or several distillation columns, in a same direction, and at least one sealed chamber for confining a fluid containing the or each heat exchange body, the confining chamber comprising a central section of generally cylindrical shape along a longitudinal axis, the longitudinal axis of the central section of said or each confinement chamber being substantially orthogonal to the direction of countercurrent circulation of the fluids in the flat passages of the corresponding heat exchange body.

The term "substantially orthogonal" comprises spacings up to 30°, or 20°, or preferably 10° from strict orthogonality.

It is sometimes necessary to orient the vaporizer so as to facilitate draining of the liquids.

BACKGROUND OF THE INVENTION

A vaporizer-condenser of this type is known from DE 1152432, in which the confinement chamber is limited in part by the heat exchange body, the liquid bath of the vaporizer being located exclusively outside the confinement element.

The invention is applicable in particular to double column air distillation installations, which is to say with a medium pressure column thermally connected to a low pressure column, provided with vaporizers-condensers of mentioned type.

In such installations for the distillation of air, the liquid oxygen which is in the base of the low pressure column is vaporized in the vaporizer-condenser by heat exchange with gaseous nitrogen from the head of the medium pressure column.

For a given operating pressure of the low pressure column, the temperature difference between the oxygen and the nitrogen rendered necessary by the structure of the vaporizer-condenser dictates the operating pressure of the medium pressure column.

It is therefore desirable that this temperature difference be as small as possible, so as to minimize the expenses connected with the compression of air to be treated injected into the medium pressure column.

The reduction of the temperature difference between the nitrogen and the oxygen requires, to preserve the heat exchange capacity of the vaporizer-condenser, increasing the heat exchange surface in this latter.

A first solution would consist in increasing the height of the heat exchange body of the vaporizer-condenser to increase the heat exchange surface. However, such an increase of height leads to a hydrostatic overpressure in the oxygen passages which tend to increase the temperature difference and which would impede the good operation of the vaporizer-condenser.

Another solution would consist in multiplying the number of passages dedicated to the oxygen and to the nitrogen, for example by increasing the number of the juxtaposed heat exchange blocks which constitute the exchanger body and which operate in parallel in the vaporizer-condenser.

Generally speaking, in double column distillation installations, the low pressure column surmounts the vaporizer-condenser which itself surmounts a medium pressure column. The central section of the sealed chamber of the vaporizer-condenser is thus constituted by a sleeve with a vertical axis of revolution. This sleeve is preferably of the same diameter as the sleeves delimiting the medium pressure and low pressure columns.

The use of the second solution to increase the heat exchange surface in such a distillation installation would thus require having a vaporizer-condenser sleeve of a diameter greater than those of the medium and low pressure columns.

The cost of construction of such an installation would thus be relatively high, particularly because of the large diameter of the sleeve of the vaporizer-condenser and the particular connection pieces to be provided between the sleeve of the vaporizer-condenser and the sleeves of the medium and low pressure columns.

SUMMARY OF THE INVENTION

The invention has for its object to solve this problem by providing a vaporizer-condenser of the mentioned type, which can function with reduced temperature differences and which permit particularly building double column air distillation installations that are relatively simple and of low cost to construct.

To this end, the invention has for its object a vaporizer-condenser of the mentioned type, characterized in that the chamber is located outside of any distillation column and is adapted to contain a bath of liquid to be vaporized.

According to particular embodiments, the vaporizer-condenser can comprise one or several of the following characteristics, taken alone or according to any possible technical combination:

- said or each chamber is formed such that in use, a bath of liquid can surround at least the lower part of the heat exchange body and preferably overflow the upper edge of the latter;
- said or each heat exchange body comprises several juxtaposed heat exchange blocks along the longitudinal axis of the central section of the corresponding confinement chamber;
- said or each heat exchange body comprises inlet and outlet connections for fluids, these connections communicate with flat passages of the heat exchange body and are assigned pair-wise to a fluid, the connections of each pair of inlet and outlet connections assigned to a same fluid being disposed substantially symmetrically relative to a longitudinal and median plane of said heat exchange body;
- said or each of said heat exchange bodies comprises at least one inlet collector and an outlet collector connected respectively to a pair of inlet and outlet connections assigned to a same fluid;
- for said or each heat exchange body, the outlet or inlet collector or collectors are supported by a same region, particularly the longitudinal end, of the corresponding confinement chamber;

for said or each confinement chamber, the central section has a general shape of revolution about its longitudinal axis and preferably the chamber is cylindrical;

- said or each confinement chamber is or is not delimited, at the level of its central section, in part by the corresponding heat exchange body;
- said heat exchange body comprises inlet and outlet connections for fluids communicating with the flat passages of said heat exchange body, and these connections are disposed outside said confinement chamber;

said or each heat exchange body comprises inlet connection for a gas communicating with passages of the heat exchange body, said heat exchange body comprising means for introduction into these passages of the condensed gas present in said inlet connections;

the flat passages of the at least one body are oriented transversely relative to the longitudinal direction of the confinement chamber.

the vaporizer comprising at least two bodies, one having flat passages or oriented transversely relative to the longitudinal direction of its confinement chamber and the other having flat passages oriented parallel relative to the longitudinal direction of its confinement chamber.

The invention moreover has for its object an installation for the distillation of air, characterized in that it comprises a vaporizer-condenser as defined above, and in that the longitudinal axis of the central section of said or each confinement chamber of the vaporizer-condenser is substantially horizontal.

"Substantially horizontal" means "horizontal or having departures up to 30°, preferably 10°, from the horizontal".

Obviously, the heat exchanger within the chamber must remain horizontal so that its operation will be ensured.

According to modifications:

the installation comprises a medium pressure column, a low pressure column, nitrogen from the head of the medium pressure column and oxygen from the bottom of the low pressure column being placed in heat exchange relation by the vaporizer-condenser;

said or each confinement chamber is disposed beside medium pressure and low pressure columns;

at least a portion of the vaporizer-condenser is disposed at a level intermediate those of the bottom of the low pressure column and the top of the medium pressure column;

the chamber contains a liquid oxygen bath in which the body is submerged in use and the installation comprises a principal heat exchange line to cool the air to be distilled, and the vaporizer-condenser surmounts the principal heat exchange line, the vaporizer-condenser and the principal heat exchange line having if desired parallel axes.

BRIEF DESCRIPTION OF THE DRAWINGS

The invention will be better understood from a reading of the description which follows, given solely by way of example and with respect to the accompanying drawings, in which:

FIG. 4 is a schematic half view in vertical transverse section of the vaporizer-condenser of the installation of FIG. 1 and shows particularly the structure of a nitrogen passage, FIG. 5 is a schematic view in vertical transverse cross-section, showing an oxygen passage of the vaporizer condenser of the installation of FIG. 1, FIGS. 6 and 7 are views analogous to FIG. 4 showing two modifications of the invention.

DETAILED DESCRIPTION OF THE INVENTION

Figure 1:
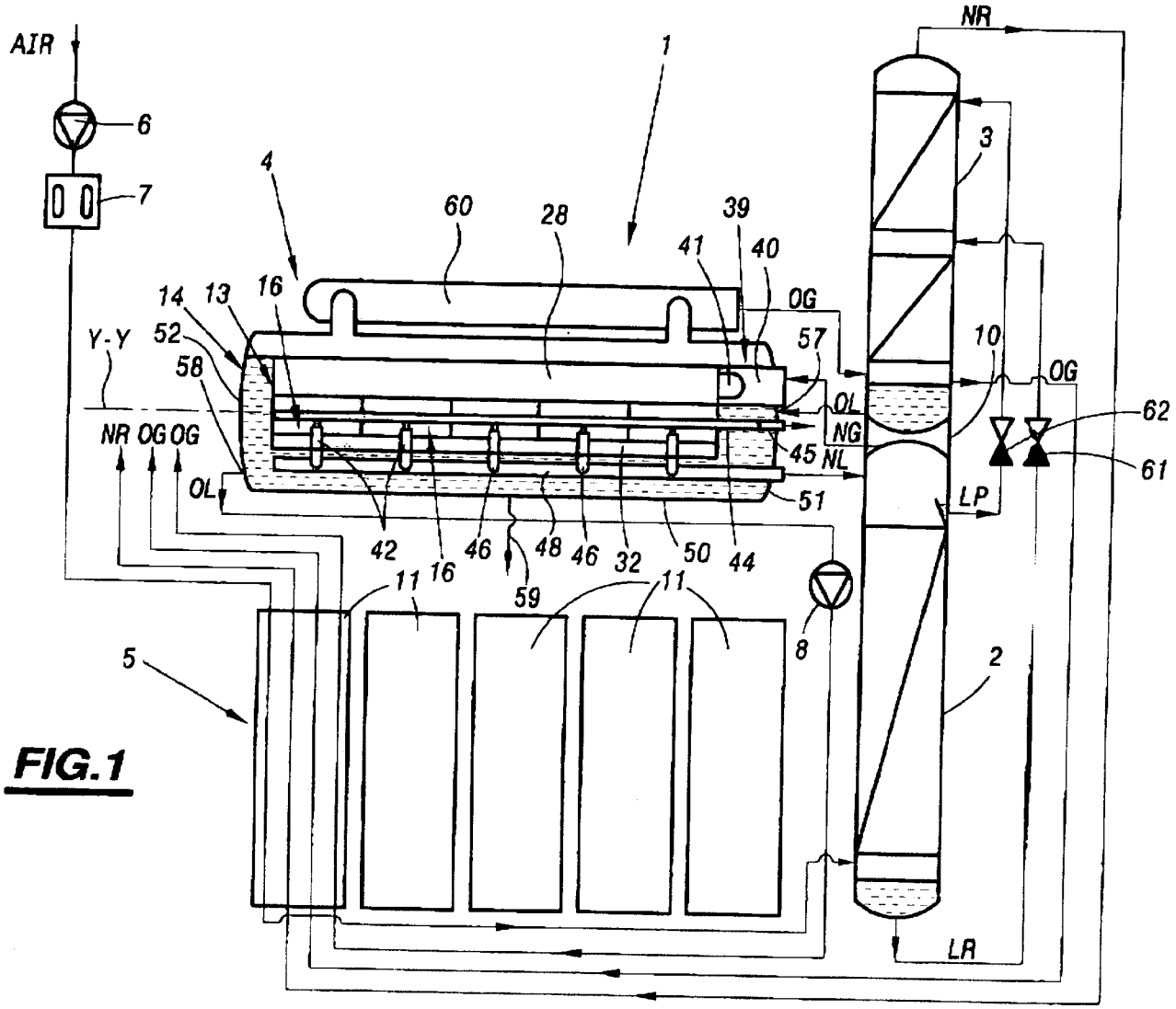
FIG. 1 is a schematic view of an air distillation installation according to the invention.

FIG. 1 shows schematically an installation 1 for the distillation of air, which comprises essentially:

a double distillation column which comprises a medium pressure column 2, a low pressure column 3 and a vaporizer-condenser 4 of the bath type, a principal heat exchange line 5, an air compressor 6, an air purification apparatus 7, and a pump 8.

The low pressure column 3 surmounts the medium pressure column 2. A vertical sleeve 10 maintains the top of the medium pressure column 2 spaced from the bottom of the low pressure column 3.

The principal heat exchange line 5 comprises, in the illustrated example, five heat exchange blocks 11. These heat exchange blocks 11 are connected in parallel to the rest of the installation 1 but, for greater clarity, the connections of only a single one of these blocks have been shown in FIG. 1. The nature of these connections will become more clear during the description of the operation of the installation 1 which will be made later.

Figure 2:
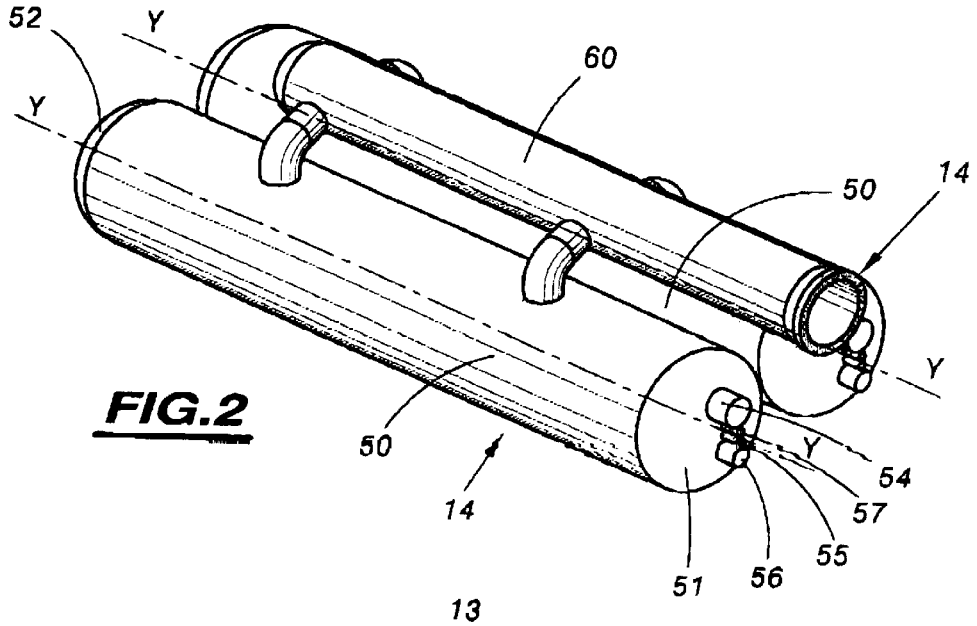
FIGS. 2 and 3 are schematic perspective views showing respectively the oxygen confinement chambers and the heat exchange body of the vaporizer-condenser of the installation of FIG. 1.
Figure 3:
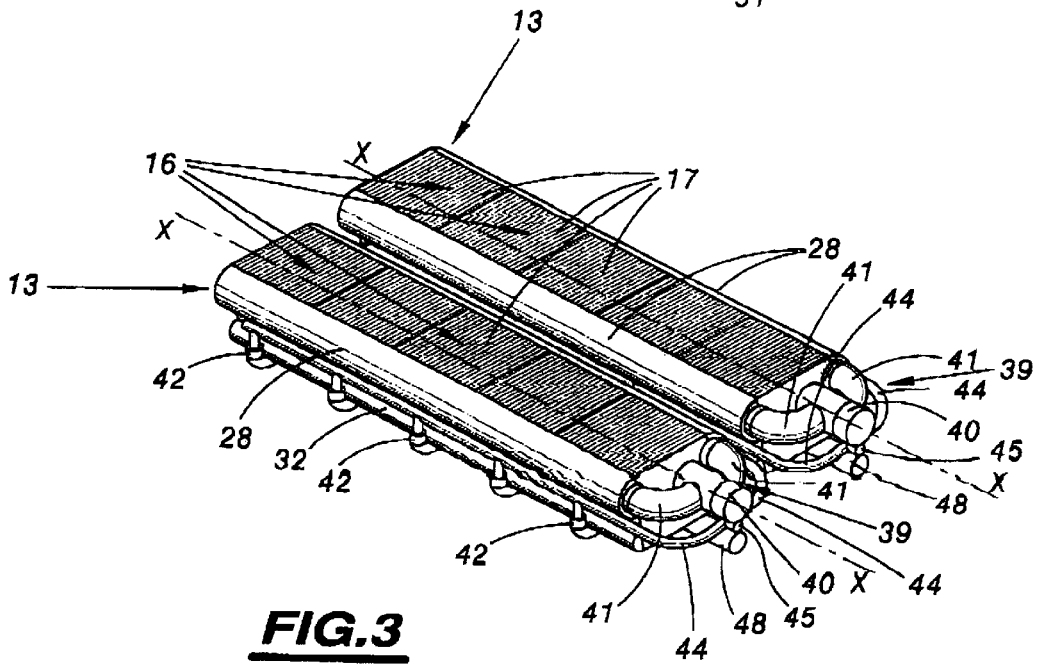

As shown in FIGS. 1 to 4, the vaporizer-condenser 4 comprises two identical heat exchange bodies 13 (FIG. 3) of brazed aluminum, which are disposed each in a sealed and cylindrical chamber 14 for confinement of oxygen, in stainless steel or aluminum (FIG. 2). A single heat exchange body 13 and a single oxygen confinement chamber 14 are shown in FIG. 1.

It will be understood that a vaporizer-condenser according to the invention can comprise only a single heat exchange body and hence a single confinement chamber or at least three heat exchange bodies, each having its own chamber. Each body 13 has a height between 400 and 1400 mm.

The vaporizer-condenser 4 being symmetrical relative to a vertical plane P whose trace is visible on FIG. 4, only a half of the structure of this vaporizer-condenser 4 will be described below. Thus, a single heat exchange body 13 and a single sealed chamber 14 will thus be described in what follows.

The heat exchange body 13 has a generally elongated shape along a horizontal or substantially horizontal longitudinal axis X—X and comprises, in the illustrated example, five heat exchange blocks 16 with analogous and joined brazed plates. The five blocks 15 are substantially identical; their number is selected as a function of the size of the vaporizer, thereby facilitating the dimensioning, because identical blocks will be mass-produced. Thus, there can be at least five or more than five blocks 15. The heat exchange body 13 is symmetrical relative to a longitudinal, vertical and median plane Q whose trace is visible on FIG. 4.

Each heat exchanger block 16 comprises a stack of parallel rectangular brazed plates 17 which define two-by-two passages designated alternately to nitrogen and oxygen. The spacing between the parallel plates 17 is fixed by corrugated partitions which also fulfill the function of thermal fins. The flat passages of the blocks are oriented transversely relative to the longitudinal dimension of the chamber 14.

The passage 18 dedicated to nitrogen is visible in FIG. 4.

This passage 18, as all the passages 18 dedicated to nitrogen, is rectangular and comprises a principal central heat exchange region 19, two inlet distribution regions 20 and two outlet collecting regions 21.

The principal heat exchange region 19 comprises a corrugated spacer with vertical generatrices. Each inlet distribution region 20 is in the form of a right angle triangle, disposed in an upper corner 22 of the passage 18 and comprises a corrugated partition with horizontal generatrices. The two inlet distribution regions 20 reunite at the level of the median plane Q, the large bases of these right triangular regions 20 being horizontal.

The structure and arrangement of the outlet collection regions 21 is similar to that of the inlet distribution regions 20, these regions 21 each being disposed at the level of a lower corner 23 of the passage 18.

The passage 18 is closed over all its periphery by vertical and horizontal bars except for a portion at the level of the small vertical bases 24 of the inlet triangular regions 20 and the small vertical bases 25 of the triangular outlet regions 21, and on the other hand, at the level of liquid nitrogen introduction means, which will be mentioned later.

The small bases 24 and 25 of the inlet regions 20 and outlet regions 21 of the five heat exchange blocks 16 form, on each side of the heat exchange body 13, respectively a series of inlet windows and a series of outlet windows for nitrogen, aligned horizontally.

Each series of inlet windows 24 is capped hermetically by an inlet box 28 of a semicircular cross-section, which extends along the five heat exchange blocks 16.

Each inlet box 28 is disposed adjacent upper corners 22 of the nitrogen passages 18 and at a height along the vertical substantially greater than that of the small bases 24 of the inlet distribution regions 20.

Each nitrogen passage 18 moreover comprises adjacent the lower edge of each box 28, introduction means 30 in the liquid nitrogen passage 18 present in the bottom of the box 28. These means 30 are in the form for example of a triangular region communicating with the bottom of the inlet box 28. Such a triangular region converges toward the plane Q and comprises a corrugated partition with oblique generatrices inclined downwardly and toward the interior of the passage 18. According to a modification (not shown), such liquid nitrogen introduction means 30 need have no corrugation to guide the liquid nitrogen or can be constituted by a bar regularly pierced with openings.

Each series of outlet windows 25 of the passages 18 dedicated to nitrogen, is hermetically capped by an outlet box 32, of semi-circular cross-section of a radius less than that of the inlet boxes 28. Each outlet box 32 extends longitudinally along five heat exchange blocks 16. Each outlet box 32 is disposed adjacent lower corners 23 of the passages 18 dedicated to nitrogen and at a height, along the vertical, less than that of the small bases 25 of the outlet collector regions 21.

FIG. 5 is a vertical transverse cross-sectional view showing the structure of a passage 34 of the heat exchange body 13 dedicated to oxygen. Such a passage 34, as are all the passages 34 dedicated to oxygen, comprises a single corrugated partition 35 with vertical generatrices. This passage 34 is closed on its sides by two vertical bars 36 and opens outwardly at the level of its upper and lower horizontal edges 37 and 38, respectively.

The exchanger body 13 also comprises, at the level of its front end (to the right in FIGS. 1 and 3) a gaseous nitrogen inlet collector 39, symmetrical relative to the plane Q. This inlet collector 39 comprises a rectilinear and horizontal inlet conduit 40, and two elbowed outlet conduits 41 each connected to the front end of an inlet box 28.

Each outlet box 32 comprises, at the level of each heat exchange block 16, a vertical connection sleeve 42. Two conduits 44 for collecting incondensable rare gases, extend horizontally on opposite sides of the heat exchange body 13 and along the latter. Each collection conduit 44 is located at an intermediate level between the inlet box 28 and the corresponding outlet box 32. These conduits 44 are connected to the upper ends of the sleeves 42 and open, at the level of the forward end of the heat exchange body 13, into a collector conduit 45 for the outlet of incondensable rare gases. This outlet collector conduit 45 is horizontal and symmetrical relative to the plane Q.

Transverse elbowed conduits 46 (FIGS. 1 and 4) are disposed below the heat exchange body 13 and connect the lower ends of the connection sleeves 42 to a horizontal liquid nitrogen outlet collector conduit 48 which extends horizontally practically over all the length of the heat exchange body 13, symmetrically relative to the plane Q. This outlet collector conduit 48, like the inlet conduit 40 and the outlet collector conduit 45, projects forwardly relative to the heat exchange body 13.

As shown in FIGS. 1 and 2, the sealed chamber 14 comprises a central portion 50 of generally cylindrical shape, in the form of a metallic sleeve with an axis of revolution Y—Y. This sleeve 50 is sealingly closed at the level of its forward end by a forward partition 51 and, at the level of its rear end by a rear partition 52. These partitions 51 and 52 have a concavity directed inwardly of the chamber 14.

The chamber 50 has, in its forward partition 51, three circular passages disposed one below the other, respectively 54, 55 and 56, whose cross-sections correspond respectively to those of the inlet conduit 40 of the gaseous nitrogen inlet collector 39, of the incondensable rare gas outlet collector conduit 45, and of the liquid nitrogen outlet collector conduit 48.

Another liquid oxygen supply passage 57 is provided in this forward partition 51 between the passages 54 and 55.

A passage 58 (FIG. 1) for liquid oxygen withdrawal is provided in the rear partition 52.

A purge 59 is provided in the bottom of the central section 50 of the sealed chamber 14.

The heat exchange body 13 is disposed in the sealed chamber 14, their longitudinal axes X—X and Y—Y being parallel. The inlet conduit 40, the outlet collector conduit 45 and the outlet collector conduit 48 pass to the exterior of sealed chamber 14 respectively through the passages 54, 55 and 56.

As shown in FIG. 2, the two sealed chambers 14 are disposed with their longitudinal axes Y—Y parallel and horizontal. The sealed chambers 14 are symmetrically connected relative to the plane P to a common pipe for the evacuation of gaseous oxygen, which extends above the sealed chamber 14, parallel to their longitudinal axes Y—Y.

The vaporizer-condenser 4 is disposed beside the medium pressure column 2 and low pressure column 3, above the principal heat exchange line 5 whose height has been reduced in FIG. 1 to facilitate illustration. The vaporizer-condenser 4 is supported by the heat exchange line 5 by means of partitions (not shown). A portion of the heat exchange body 13 of the vaporizer-condenser 4 is disposed at an intermediate level between the bottom of the low pressure column 3 and the top of the medium pressure column 2.

The operation of the installation 1 will now be described.

Air to be distilled, first compressed by the compressor 6 and purified by the apparatus 7, passes through the heat exchange line 5 to cool to its dew point. This cooling is ensured in parallel by the heat exchange blocks 11. Then the cooled oxygen is injected into the bottom of the medium pressure column 2.

The gaseous nitrogen from the head of the medium pressure column 2 is introduced by inlet collectors 39 into the two inlet boxes 28 of each heat exchange body 13. This gaseous nitrogen is distributed, by distribution regions 20, uniformly over all the width of the passages 18 dedicated to nitrogen of this heat exchange body 13. The nitrogen then flows vertically downwardly in the regions 19 of the passages 18 while progressively condensing.

Liquid nitrogen that may be present in the bottom of the inlet boxes 28 is introduced into the regions 19 of the passages 18 by the introduction means 30. This liquid nitrogen then flows vertically downwardly with the nitrogen condensed in the regions 19.

The liquid nitrogen is collected at the bottom of the regions 19 of the passages 18 by means of outlet collector regions 21 and then returned to the two outlet boxes 32. The incondensable fraction contained in this nitrogen flow is sent by collector conduits 44 and outlet collector conduit 45 to the outside atmosphere. The condensed nitrogen emerging from the passages 18 is itself collected by transverse conduits 46 and by the outlet collector conduit 48 and then returned to the head of the medium pressure column 2.

Liquid oxygen from the bottom of the low pressure column 3 is introduced into each oxygen-confining chamber 14 by means of passages 57 provided in their forward partitions 51. This liquid oxygen forms a bath in each chamber 14 which fills most of the internal volume of this sealed chamber 14. The upper surface of the corresponding heat exchange body 13 projects slightly above the liquid oxygen path.

Liquid oxygen from the bath circulates vertically upwardly in the passages 34 of the heat exchange body 13 in question while vaporizing countercurrent to the nitrogen circulating in the passages 18.

The oxygen vaporized by each heat exchange body 13 is then returned by means of the nozzle 60 to the bottom of 25 the low pressure column 3.

"Rich liquid" LR (liquid enriched in oxygen), from the bottom of the medium pressure column 2, is expanded in an expansion valve 61 and then injected at an intermediate level into the lower pressure column 3.

"Poor liquid" LP (somewhat pure nitrogen), from the head of the medium pressure column 2, is expanded in an expansion valve 62 and then injected at the top of the low pressure column 3.

Impure or "residual" nitrogen NR, withdrawn from the top of the low pressure column 3, is reheated by passing through the principal heat exchange line 11.

Gaseous oxygen, from the head of the low pressure column 3, is reheated in the principal heat exchange line 5. Liquid oxygen, withdrawn from the passages 58 of the sealed chambers 14 and the pump, is vaporized by passing through the principal heat exchange line 5.

Purges 59 permit evacuating impurities which accumulate in the bottom of the oxygen confinement chambers 14.

The structure of the vaporizer-condenser 4 and the position of the sealed chambers 14 permit achieving relatively great heat exchange surfaces by juxtaposition of heat exchange blocks 16.

Moreover, the cost of such a vaporizer-condenser 4 is relatively reduced because of the relatively small diameter of the central sections 50 of the oxygen confinement chambers 14 and by the simplicity of the structure of these chambers 14. The size of the vaporizer-condenser 4 is also relatively small because of the small diameter of the central sections 50 of the chambers 14.

Moreover, because of the position of the vaporizer-condenser 4, the circulation of the different fluids between the head of the medium pressure column 2 and the bottom of the low pressure column 3 and the vaporizer-condenser 4 can be ensured while limiting the pumping means.

It will also be seen that, for a given air distillation capacity, the length and the ground surface of the heat exchange line 5 are comparable to those of the vaporizer-condenser 4. Moreover, the height of the medium pressure column 2, and hence the height at which the vaporizer-condenser 4 must be positioned, corresponds practically to the height of the principal heat exchange line 5 added to the height necessary for the various connections of this line with the rest of the installation 1. Thus, the height of the support partitions of this vaporizer-condenser 4 is limited.

It will be noted that the symmetry of the structure of the heat exchange bodies 13 permits decreasing the height of the inlet distribution regions 20 and outlet collecting regions 21 and hence, for a given exchange height, minimizing the hydrostatic overpressure which is harmful to obtaining a small temperature difference.

Moreover, in the case in which the oxygen confinement chambers 14 and the heat exchange bodies 13 will be of different metal requiring the use of mixed junctions, the structure and the presence for each heat exchange body 13 of the inlet connector 39, of the single outlet collector 45 and of the outlet collecting conduit 48, permit limiting the number of these junctions. Thus, it is not necessary to provide such junctions but at the level of the inlet conduit 40 of the inlet collector 39, of the outlet collector 45, and of the forward end of the outlet collector conduit 48.

The fact that the inlet collector 39, the outlet collector conduit 45 and the outlet collector conduit 48 are carried by a same region of the forward partition 51 of each oxygen confinement chamber 14, also permits limiting the inconvenience connected with the difference of the coefficients of thermal expansion between the chambers 14 and the heat exchange bodies 13.

A satisfactory circulation of liquid oxygen in the bath of each chamber 14 is ensured by the fact that the liquid oxygen supply and withdrawal passages 58 are located at opposite ends of each chamber 14.

Finally, to provide vaporizer-condensers 4 of different capacities as a function of specific needs of different air distillation installations 1, it suffices to modify the number of heat exchange blocks 16, the number and the diameter of the different connections, and the length of the sleeves 50.

FIG. 6 shows a modification of the invention which is distinguished from that of FIGS. 1 to 5 particularly by what follows.

A portion of 70 of the internal flank of the central section 50 of each chamber 14 is constituted by a flank 71 of the corresponding heat exchange body 13. The general cylindrical shape of the central sections 50 is thus no longer one of revolution.

Each heat exchange body 13 no longer has a symmetrical structure and comprises, for each passage 18 dedicated to nitrogen, a single triangular inlet distribution region 20 and a single triangular outlet collection region 21 each of which extends over all the width of the passage 18 in question.

A single inlet box 28 and a single outlet box 32 are connected to each heat exchange body 13 on its flank 71. These boxes 23 and 25 are located outside the corresponding oxygen confinement chamber 14.

Gaseous nitrogen is supplied from the head of the medium pressure 2 to the two inlet boxes 28, by means of a common inlet collector conduit 73 and two series of transverse conduits 74. The inlet collector conduit 73 is horizontal and symmetrical relative to the plane P. Each series of conduits 74 comprises transverse conduits 74 regularly spaced from each other and supplying a same inlet box 28.

Similarly, an incondensable rare gas outlet collector conduit 75, common to the two outlet boxes 32, extends horizontally and symmetrically relative to the plane P.

This outlet collector conduit 75 is connected to each outlet box 32 by a series of transverse conduits 76 regularly spaced from each other.

Similarly, a condensed liquid nitrogen outlet collector conduit 77, common to the two outlet boxes 32, extends horizontally and symmetrically relative to the plane P.

This outlet collector conduit 77 is connected to each outlet box 32 by a series of transverse conduits 78 regularly spaced from each other. The condensed nitrogen is thus returned to the head of the medium pressure column 2 by means of the outlet collector conduit 77.

The supply of liquid oxygen for each oxygen confinement chamber 14 is ensured by an inlet collector conduit 80 disposed in the chamber 14 in question, parallel to the axis Y—Y, and regularly pierced by distribution openings. Withdrawal of liquid oxygen from each chamber 14 is ensured by a series of transverse conduits 81 opening into the bottom of the chamber 14 and by a horizontal outlet collector conduit 42 which is symmetrical relative to the plane P and common to the two chambers 14.

The fact that the inlet boxes 28 and outlet boxes 32 of each heat exchange body 13 are situated outside the oxygen confinement chambers 14, permits improving the safety of the vaporizer-condenser 4. It is thus no longer necessary to take into account a possible malfunction of the connections to determine the thickness of the wall of the central body 50 of each oxygen confinement chamber 14.

The modification of FIG. 6 also permits simplifying the structure of the heat exchange bodies 13 and their connections to the rest of the installation 1.

Moreover, the inlet collector conduit 80, the transverse conduits 81 and the common outlet collector conduit 82 permit ensuring a good circulation of liquid oxygen in the bath of each chamber 14. It is to be noted that such conduits can also be provided in the modification of FIGS. 1 to 5.

Figure 7:
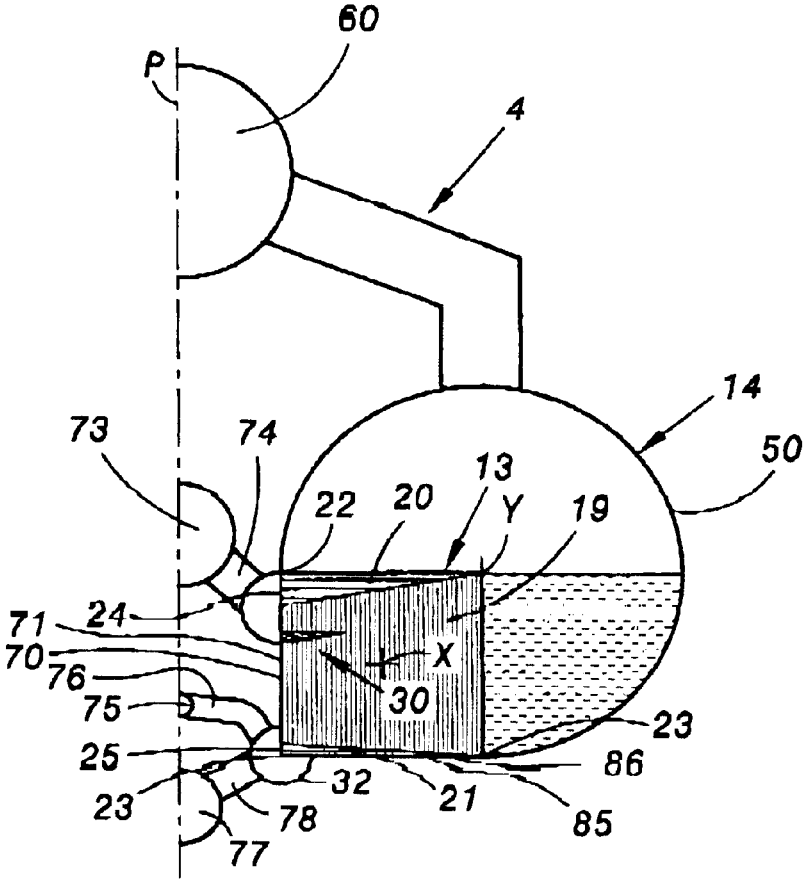
Figure 8:
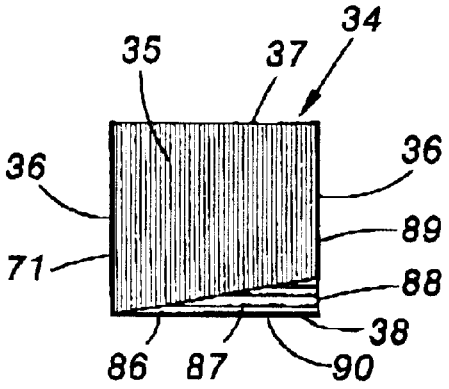
FIG. 8 is a view similar to FIG. 5 showing the structure of an oxygen passage for the modification of FIG. 7.

FIGS. 7 and 8 show another modification of the invention which is principally distinguished from that of FIG. 6 by what follows.

For each oxygen confinement chamber 14, a portion of body 85 of the central body 50 of the chamber is formed by the lower wall 86 of the corresponding heat exchange body 13. Each outlet box 32 has a section covering the three quarters of a circle and covers a lower corner 23 of the corresponding heat exchange body 13.

As shown in FIG. 8, each passage 34 dedicated to oxygen has an inlet distribution region 87. This region 87 is in the form of a right triangle, and is disposed at the level of the lower edge 38 of the passage 34 and extends over all the width of this passage 34. The region 87 converges toward the flank 71 of the heat exchange body 13. The small face 88 of the inlet distribution region 87 is located at the level of the flank 89 of the heat exchange body 13 opposite the flank 71. The passage 34 is closed on its lateral sides by two vertical bars 36, except at the level of the small base 88 of the inlet distribution region 87, and by a horizontal bar 90 at the level of the lower edge 38 of the passage 34.

The liquid oxygen supply and withdrawal of each chamber 14 are ensured as in the case of FIGS. 1 to 5.

As in the case of the modification of FIG. 6, this modification permits simplifying the structure of the heat exchange bodies 13 and their connections to the rest of the distillation installation 1.

What is claimed is:

1. An air distillation installation comprising:

a distillation apparatus comprising at least one distillation column;

a vaporizer-condenser in heat exchange relation with the distillation apparatus and located outside each of said at least one distillation column and adapted to contain a bath of liquid to be vaporized.

2. The installation according to claim 1, wherein the distillation apparatus comprises a medium pressure column and a low pressure column, nitrogen from the top of the medium pressure column and oxygen from the bottom of the low pressure column being placed in heat exchange relation by the vaporizer-condenser.

3. The installation according to claim 2, wherein the vaporizer-condenser is disposed beside the medium and low pressure columns.

4. The installation according to claim 2, wherein at least a portion of the vaporizer-condenser is disposed at an intermediate level between the bottom of the low pressure column and the top of the medium pressure column.

5. The installation according to claim 3, further comprising a principal heat exchange line to cool air to be distilled, and the vaporizer-condenser surmounts the principal heat exchange line.

6. The installation according to claim 1, wherein the vaporizer-condenser comprises:

at least one sealed chamber for confinement of fluid;

a heat exchange body in each of said at least one confinement chamber and having a flat passage for the countercurrent circulation of fluids; and wherein each of said at least one confinement chamber comprises a central section of generally cylindrical shape about a longitudinal axis, the longitudinal axis being substantially orthogonal to the direction of countercurrent circulation of the fluids in the flat passage of the heat exchange body.

7. The installation according to claim 6, wherein said heat exchange body comprises several heat exchange blocks juxtaposed along the longitudinal axis of the central section of each of said at least one confinement chamber.

8. The installation according to claim 6, wherein each of said at least one chamber is formed such that in use, a bath of liquid can surround at least the lower portion of the heat exchange body.

9. The installation according to claim 6, wherein said heat exchange body comprises inlet and outlet connections for fluids, the connections communicate with the flat passage and are pair-wise assigned to one fluid, the connections of each pair of inlet and outlet connections assigned to a same fluid being disposed substantially symmetrically relative to a longitudinal and median plane of said heat exchange body.

10. The installation according to claim 9, wherein said heat exchange body comprises at least one inlet connector and one outlet connector, connected respectively to a pair of inlet and outlet connections assigned to a same fluid.

11. The installation according to claim 10, wherein the at least one outlet collector and the inlet collector are supported by a same region of the corresponding confinement chamber.

12. The installation according to claim 6, wherein the central section has a general shape of revolution about the longitudinal axis.

13. The installation according to claim 6, wherein each of said at least one confinement chamber is or is not delimited, at the level of the central section, in part by the heat exchange body.

14. The installation according to claim 13, wherein said heat exchange body comprises inlet and outlet connections for fluids communicating with the flat passage, and at these connections are disposed outside each of said at least one confinement chamber.

15. The installation according to claim 6, wherein said heat exchange body comprises inlet connections for a gas communicating with the passage, and said heat exchange body comprises means for the introduction into the passage of the condensed gas present in said inlet connections.

16. The installation according to claim 6, wherein the flat passage is oriented transversely relative to the longitudinal axis of each of said at least one confinement chamber.

17. The installation according to claim 16, comprising at least two heat exchange bodies of which one has a flat passage oriented transversely relative to the longitudinal direction of its confinement chamber and another having a flat passage oriented parallel relative to the longitudinal direction of its confinement chamber.

18. A vaporizer-condenser comprising:

at least one sealed chamber for confinement of fluid;

a heat exchange body in each of said at least one confinement chamber and having a flat passage for the countercurrent circulation of fluids; and wherein each of said at least one confinement chamber comprises a central section of generally cylindrical shape about a longitudinal axis, the longitudinal axis being substantially orthogonal to the direction of countercurrent circulation of the fluids in the flat passage of the heat exchange body and means for mounting the vaporizer-condenser to the outside of a distillation column.

19. The vaporizer-condenser according to claim 18, wherein said heat exchange body comprises several heat exchange blocks juxtaposed along the longitudinal axis of the central section of each of said at least one confinement chamber.

20. The vaporizer-condenser according to claim 18, wherein each of said at least one chamber is formed such that in use, a bath of liquid can surround at least the lower portion of the heat exchange body.

21. The vaporizer-condenser according to claim 18, wherein said heat exchange body comprises inlet and outlet connections for fluids, the connections communicate with the flat passage and are pair-wise assigned to one fluid, the connections of each pair of inlet and outlet connections assigned to a same fluid being disposed substantially symmetrically relative to a longitudinal and median plane of said heat exchange body.

22. The vaporizer-condenser according to claim 21, wherein said heat exchange body comprises at least one inlet connector and one outlet connector, connected respectively to a pair of inlet and outlet connections assigned to a same fluid.

23. The vaporizer-condenser according to claim 22, wherein the at least one outlet collector and the inlet collector are supported by a same region of the corresponding confinement chamber.

24. The vaporizer-condenser according to claim 18, wherein the central section has a general shape of revolution about the longitudinal axis.

25. The vaporizer-condenser according to claim 18, wherein each of said at least one confinement chamber is or is not delimited, at the level of the central section, in part by the heat exchange body.

26. The vaporizer-condenser according to claim 25, wherein said heat exchange body comprises inlet and outlet connections for fluids communicating with the flat passage, and at these connections are disposed outside each of said at least one confinement chamber.

27. The vaporizer-condenser according to claim 18, wherein said heat exchange body comprises inlet connections for a gas communicating with the passage, and said heat exchange body comprises means for the introduction into the passage of the condensed gas present in said inlet connections.

28. The vaporizer-condenser according to claim 18, wherein the flat passage is oriented transversely relative to the longitudinal axis of each of said at least one confinement chamber.

29. The vaporizer-condenser according to claim 28, comprising at least two heat exchange bodies of which one has a flat passage oriented transversely relative to the longitudinal direction of its confinement chamber and another having a flat passage oriented parallel relative to the longitudinal direction of it s confinement chamber.

* * * * *